United States Patent [19]

Arzberger et al.

[11] 4,119,191

[45] Oct. 10, 1978

[54] VARIABLE COIN CONTROL FOR FOOD DISPENSER

[75] Inventors: William A. Arzberger, Medfield; Merle S. Brown, Cohasset, both of Mass.

[73] Assignee: Jet Spray Cooler, Inc., Waltham, Mass.

[21] Appl. No.: 766,430

[22] Filed: Feb. 7, 1977

[51] Int. Cl.[2] ..... G07F 13/00

[52] U.S. Cl. ..... 194/9 T; 194/1 L; 194/13

[58] Field of Search ..... 194/9 R, 9 T, 10, 13, 194/DIG. 1, DIG. 16, DIG. 18, DIG. 20, 1 L, 3

[56] References Cited

U.S. PATENT DOCUMENTS

| | | | |
|---|---|---|---|
| 2,901,077 | 8/1959 | Stark | 194/13 |
| 3,172,520 | 3/1965 | Greenwald | 194/9 R |
| 3,313,450 | 4/1967 | Erickson | 194/13 |
| 3,653,478 | 4/1972 | Leonhart | 194/DIG. 20 |
| 3,929,212 | 12/1975 | Burzen | 194/9 R X |

*Primary Examiner*—Joseph J. Rolla
*Attorney, Agent, or Firm*—Wolf, Greenfield & Sacks

[57] ABSTRACT

A coin-operated liquid dispensing machine having a vending control mechanism which may be conveniently altered to accept a different coin or series of coins to reflect different vending prices that are to be charged. In the disclosed arrangement vending prices of 5¢, 10¢, 15¢, 20¢, 25¢ and 30¢ are selectable. The control mechanism includes a timer motor for driving three cams each having electrical circuitry associated therewith including cam contact switches. The first cam is a stepping cam, the second an override cam and the third cam controls a dispensing gear motor. The electrical circuitry also includes 5¢ and 10¢ switches and associated relays, a relay by-pass switch, and manually operated blocking structure associated with each coin slot (5¢ and 10¢ slot). Change in vending price is accomplished by setting the cam path of the second cam to one of two different settings, operating the by-pass switch to either an open or closed position, and selectively energizing one of the blocking structure for some prices. All operations for changing price are done in accordance with a predetermined scheme to permit dispensing only after the proper coin or coins have been deposited in the machine.

19 Claims, 8 Drawing Figures

POSITIONS OF CAMS AND SWITCHES AT START OF CYCLE

5¢ AND 20¢ VEND

10¢ VEND

15¢ VEND

25¢ AND 30¢ VEND

VARIABLE COIN CONTROL FOR FOOD DISPENSER

BACKGROUND AND SUMMARY OF THE INVENTION

The present invention relates in general to vending machines and is concerned, more particularly, with a new and improved coin control assembly for vending machines which enables the owner of the machine to alter the amount of money required to activate the dispensing assembly of the machine. The concepts of the present invention are set forth in the following detailed description as they apply to a hot coffee vending machine. However, it is to be understood that the concepts of the invention have much wider use and are applicable to virtually any type of a coin operated machine. In the embodiment disclosed hereinafter the machine uses two coins, a nickel and/or a dime to provide different total vends of 5, 10, 15, 20, 25 and 30 cents.

At the present time most of the vending control devices used on small vending machines cannot be altered so as to change the vending price of the machine without either replacing the entire vending control mechanism with another one set for the new price or modifying the old mechanism by the addition of or replacement of a substantial portion of the mechanism. This is both costly and inconvenient to the owner, and the change requires the services of a skilled serviceman. Until the actual change in the vending control device is effected, the vending price cannot reflect the increased cost of the materials dispensed by the machine. In the particular machine described in the following description, it will be appreciated that the vending price must reflect fluctuations in the price of coffee. A machine which cannot readily be altered so as to reflect that change is seriously deficient. Machines of this type are frequently used in office coffee programs where cost and size limitations prohibit the use of large sophisticated vending units used in commercial establishments. It is very desirable, if not absolutely necessary, that the vending control device be capable of reflecting, for the people participating in the program, the fluctuations in coffee prices, and the changes must be capable of being made immediately, with no special costs or skills imposed upon the program or its participants.

Accordingly, one object of the present invention is to provide a vending control device which may be altered so as to reflect different vending prices without replacing the vending control device, adding new mechanisms, or modifying the existing mechanism.

Another important object of this invention is to provide a vending control device which may be altered so as to reflect change in vending prices by an untrained attendant without special skills.

A further object of the present invention is to provide a vending control device for use in small vending machines, which may be modified to change the vending price for the goods without the purchase and installation of stepping relays or similar devices that are now required to extend the price range of such vending control units.

A more specific object of the present invention is to provide a device for use in small vending machines that easily enables one to alter the price charged for the vended product and which operates on either 5¢ or 10¢ pieces permitting price charges of 5–30¢ in 5¢ increments.

To accomplish these and other objects, the vending control device of this invention includes separate coin slots for coins of each denomination. In the illustrated embodiment nickel and dime slots are used. However, it is understood that the principles of the invention may be applied to machines receiving any number of different denomination coins. A timer motor which controls the dispensing operation carries three cams, two of which control switches connected in separate parallel circuits in turn controlled by coin switches in the separate coin slots. A bypass circuit connected in series with the timer motor for bypassing one of the parallel circuits is manually set to reflect the vending price required. Additional manually operated switches are provided to block the separate coin chutes when any of them are not required to actuate the vending control devices.

These and other objects and features of the invention will be better understood and appreciated from the following detailed description of one embodiment thereof, selected for purposes of illustration and shown in the accompanying drawings.

DETAILED DESCRIPTION

Figure 1:
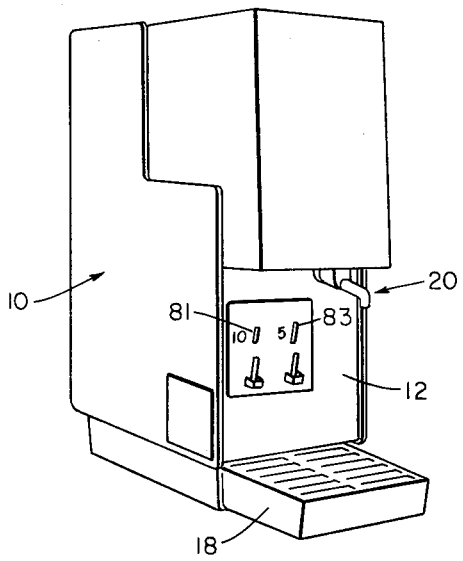
FIG. 1 is a perspective view of a vending machine embodying the present invention.
Figure 2:
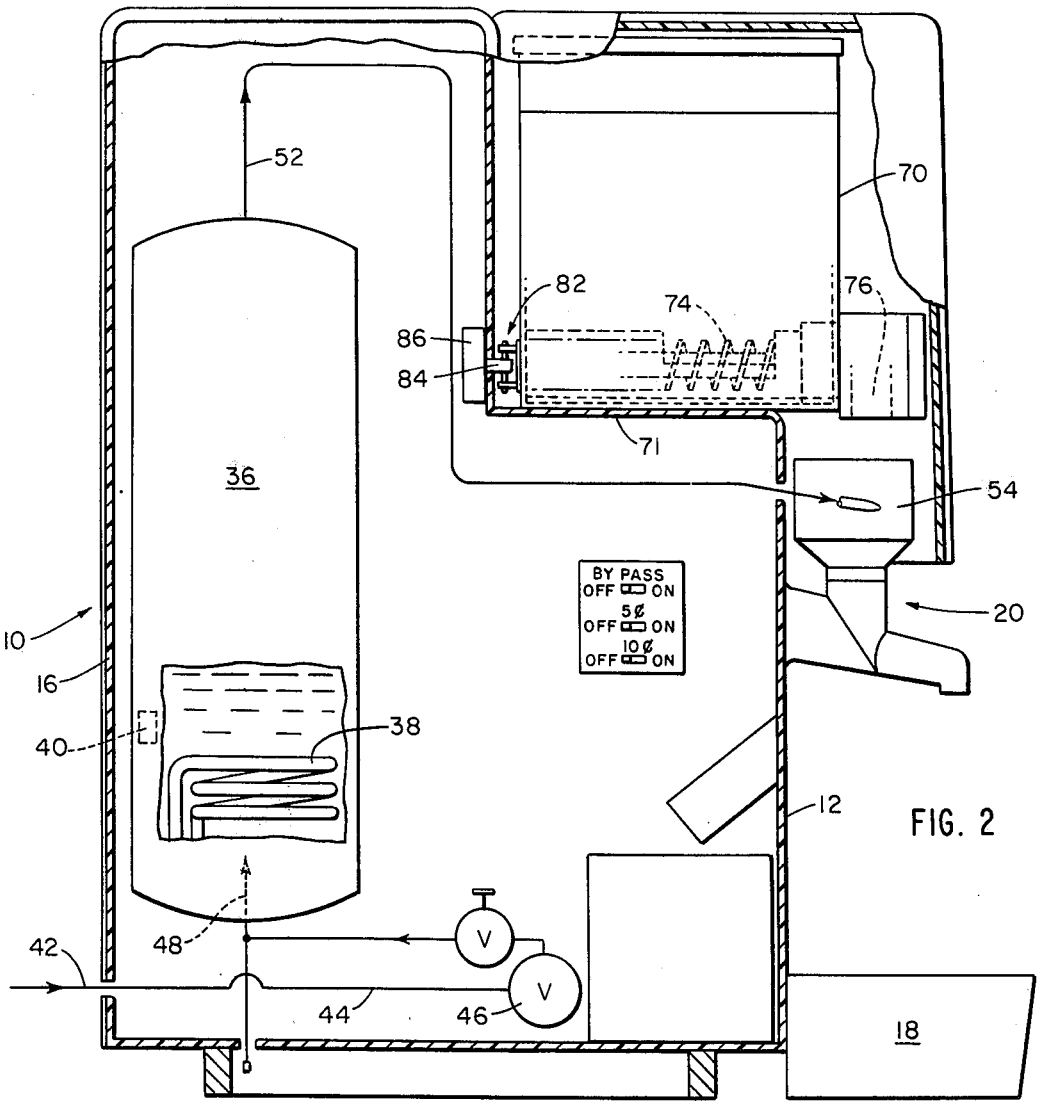
FIG. 2 is a cross-sectional view showing diagrammatically the hot water and flavor systems in the dispenser of FIG. 1.

The beverage dispenser shown in the drawing typically may be used as a coffee or hot chocolate vending machine and, as illustrated, very closely resembles the dispenser shown in copending application Ser. No. 564,772 dated Apr. 3, 1975, now U.S. Pat. No. 4,015,749 and entitled HOT COFFEE DISPENSER. This dispenser, however, as a vending machine is coin-operated rather than being operated by the mere press of a button as in the earlier application. Because much of the dispenser details do not form part of this invention, they have been omitted from the drawing and this detailed description.

The vending machine shown includes a housing 10 having a front panel 12 and rear panel 16. A drip tray 18 is mounted on the front panel 12 and is designed to support a cup (not shown) to be filled by the machine. A mixing assembly and discharge spout 20 is also mounted on the front panel 12.

The machine has separate hot water and coffee concentrate supply systems, and both are suggested in FIG. 1. The hot water supply system includes a heating tank 36 preferably holding a gallon or more of water and having heating coils 38 and thermostat 40 which control the water temperature. Hot water tank 36 is supplied by water through a system of ducts which are described and shown in detail in U.S. Pat. No. 3,737,076 dated June 5, 1973 and assigned to Jet Spray Cooler, Inc., the assignee of the present invention. Briefly, the duct system includes an inlet 42 located on back panel 16, which may be connected to a constant pressure water line. Inlet 42 is connected to duct 44 which feeds water into the bottom of the tank as suggested at 48. A solenoid valve 46 in duct 44 controls the flow of water into the tank. Hot water is discharged from the tank 36 through duct 52 connected to the top of the tank. Duct 52 exits through the front panel 12 of the housing and tangentially enters the funnel 54 of the mixing assembly and discharge spout 20.

The coffee concentrate is contained in rectangular hopper 70 supported on shelf 71 above the front panel 12. The hopper 70 contains an auger 74 used to propel the coffee concentrate through the discharge opening 76 in the front of the hopper. The coffee powder discharged through opening 76 is dumped into the top of funnel 54 where it mixes with the hot water tangentially introduced through duct 52. The auger is driven through mechanical coupling 82 connecting it to the shaft 84 of gear motor 86.

The vending control assembly shown and described is designed to selectively actuate the solenoid valve 46 and gear motor 86 by depositing the proper coins in the machine which in the illustrative embodiment are nickels and dimes for providing vending prices of from 5¢ to 30¢ in 5 cent increments. It is to be understood that other denominations of coins could be utilized.

Figure 3:
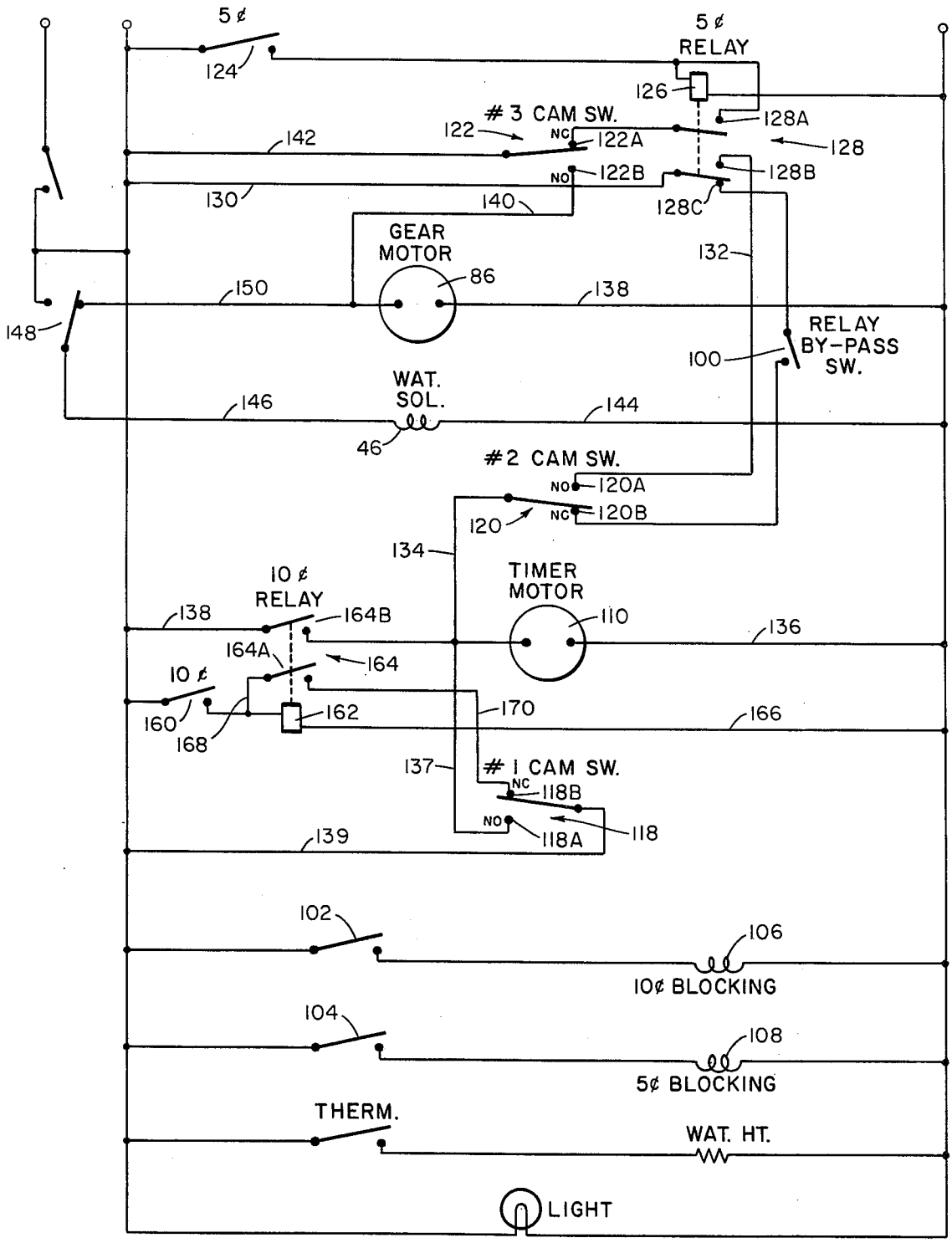
FIG. 3 is a schematic diagram of the control circuit of the vending machine.
Figure 4:
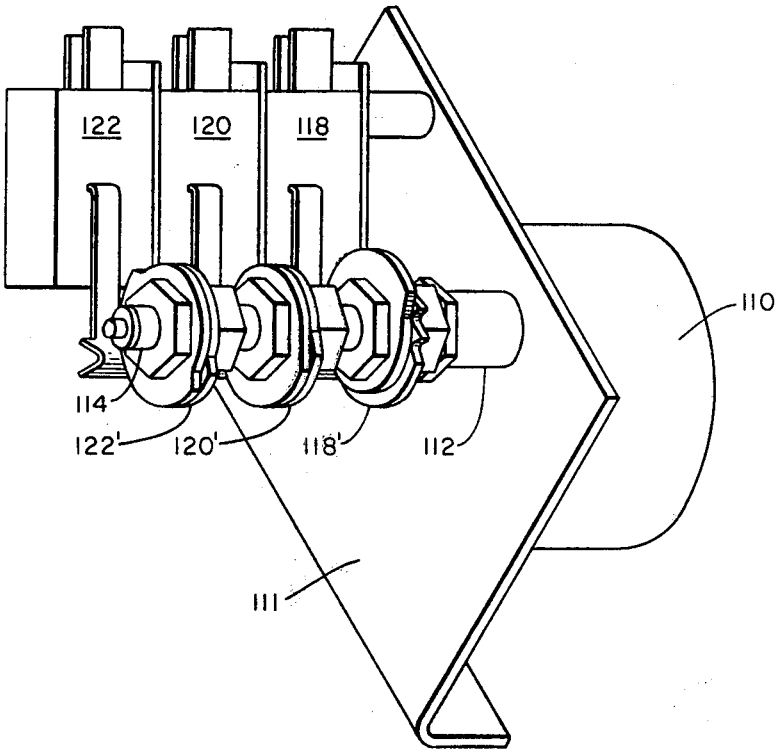
FIG. 4 is a perspective view showing a portion of the vending control of this invention including the timer motor, cams, and associated cam switches.

In the embodiment of FIG. 1, the machine is provided with coin slots 81 and 83 in the front panel 12, which accept dimes and nickels, respectively. The control circuit actuated by the coins including the gear motor 86 and the timer motor 110 is shown in FIG. 3. FIG. 4 shows the timer motor 110, the cams 118', 120', and 122', and associated cam switches, 118, 120 and 122. The cams 118' and 122' are fixed cams while the cam 120' has a variable cam track settable to one of two different positions as discussed in more detail hereinafter. FIGS. 5A–5D show cam timing diagrams also discussed in more detail hereinafter and associated with the operation of the circuit diagram of FIG. 3. The diagram of FIGS. 5A–5D is shown with the cams and cam switches shown at the beginning of a cycle.

Referring now to FIGS. 3 and 4, there is shown the basic control for the coin operated machine. The circuitry in FIG. 3 may be contained within the dispenser housing without accommodating a great deal of space. The timer motor 110 and its associated cams may also be suitably supported in the housing from the support bracket 111 shown in FIG. 4. The control circuit controls the solenoid valve 46 which in turn controls the flow of water to the tank 36, and the gear motor 86 which drives the auger 74 which in turn dispenses the coffee concentrate from the container 70.

The housing 10 preferably has a side panel (not shown) that is easily removed to provide direct access to the mechanisms within the housing. The cams are positioned so that there is easy access thereto for adjustment in particular of the second cam 120'. Also suitably mounted within the housing are switches 100, 102 and 104. Each of these switches must be set in a prescribed position depending upon the amount to be charged for the drink dispensed. In accordance with the present invention the machine may be set so that the drink costs from 5¢ to 30¢ in 5 cent increments. The switch 100 is identified as a by-pass switch which, depending upon the position thereof, can control the timer motor 110 via the relay 128. The switch 102 controls the blocking solenoid 106 for the 10¢ slot, and the switch 104 controls the blocking solenoid 108 for the nickel slot. Each of the solenoids 106 and 108 has associated therewith a mechanical blocking plate so that when either of the solenoids is deenergized the plate blocks the associated slot and does not permit insertion of the coin associated with the particular blocking solenoid. Both solenoids do not block at the same time, except when power is off but either or none may block. When the machine is to be set so as to be activated by the depositing of a nickel, obviously, the 10¢ blocking solenoid is to be deactivated so as to close the 10¢ coin chute to prohibit the insertion of a 10¢ coin into the machine. On the other hand, the blocking solenoid for the 5¢ chute is activated so as to allow the insertion of a 5¢ coin into its chute.

FIG. 4 shows the timing motor 110 which includes a shaft preferably connected by way of a gear box 112 to an output shaft 114, commonly supporting and carrying the three cams 118', 120' and 122'. As previously mentioned, each of the cams has a switch associated therewith which may be opened and closed depending on the particular position of its respective cam. The cam switches are also shown in FIG. 3. When the cam switch is on the high point of the cam the normally closed contact of the switch is opened and when the cam switch is on the low area of the cam then the normally closed contact of the switch is closed.

Figure 5A:
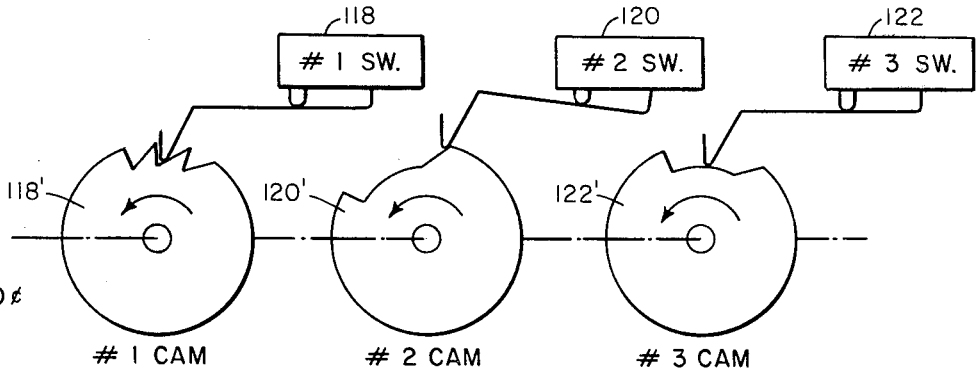
FIGS. 5A–5D are diagrammatic views showing the different settings for the cams of the control device which render the device responsive to different vending prices.
Figure 5B:
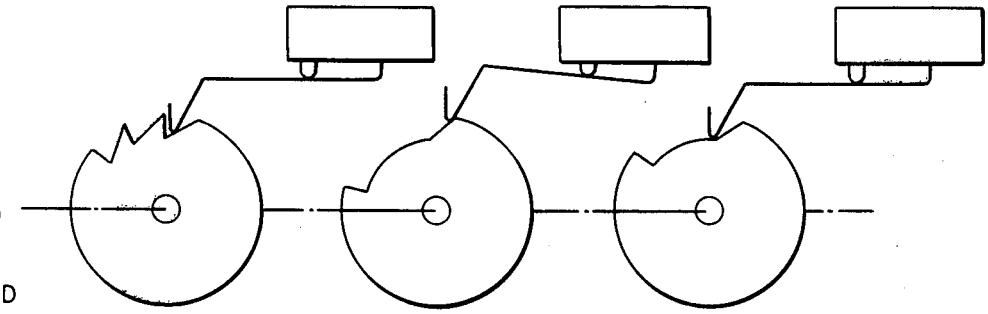
Figure 5C:
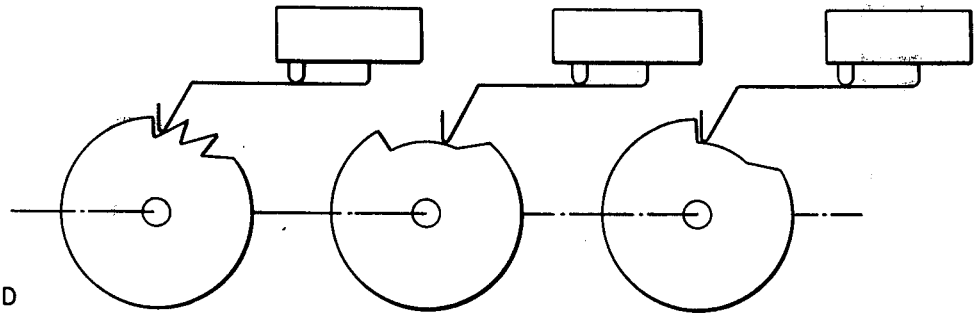
Figure 5D:
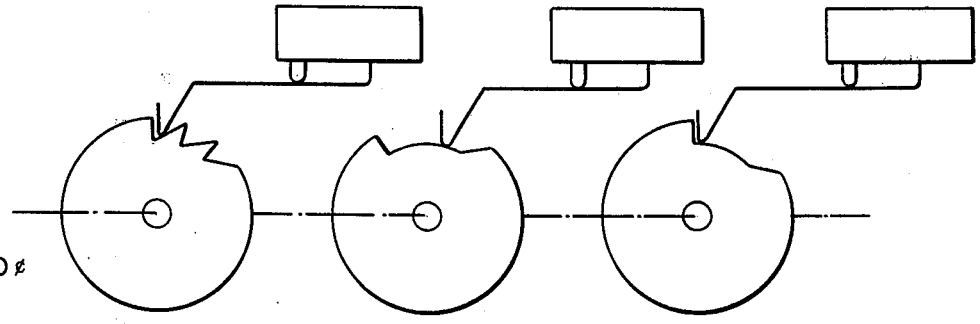

There are basically three different settings that have to be made in accordance with a predetermined schedule allotted the user of the machine in order to make the different coin settings. The by-pass switch 100 has to be either in its open or closed position. The switches 102 and 104 have to be set to their proper position for either providing blocking or not. Lastly, the center cam must be set in either one of two positions. As shown in FIG. 4 this cam has two cam halves that are adjustable relative to each other with one of the cam halves being white and the other black. The black cam has a white mark thereon which may be moved to align with one of two black marks on the white cam. FIGS. 5C and 5D show the different relative positions of the middle cam as in these diagrams the first and third cams are in the same position. For simplicity, the cams shown in FIGS. 5A–5D are shown as single cam tracks it being understood that two cam halves may be rotated relative to each other to provide these cam tracks.

The operation of the circuitry of FIG. 3 will now be discussed in sequence with reference to each coin or series of coins that are deposited for dispensing the product. For the 5¢ vend reference is also made to the timing diagram of FIG. 5A. For the 5¢ setting switch 100 is closed, switch 102 is maintained opened and switch 104 is maintained closed. In these positions of switches 102 and 104 only the solenoid 108 is energized causing the associated 5¢ slot to be opened. Both of the blocking solenoids are arranged so that the coin slots are blocked when the solenoid is de-energized. When a 5¢ piece is deposited in the appropriate slot, the coin operated switch 124 closes to instantaneously complete the circuit to the coil 126 of relay 128. When coil 126 is energized the contacts associated therewith move from the position shown in FIG. 3 so that the switch contact 128A closes, the contact 128B closes and the contact 128C opens. The contact 128A functions as a holding contact for the relay 126. The contact 128A provides a completed circuit for the coil 126 through the normally closed contact 122A of the third cam switch 122. All cam switches in FIG. 3 are shown in their normally closed position. Regarding FIG. 5A switch 118 has its normally closed contact closed, switch 120 has its normally closed contact open and switch 122 has its normally closed contact closed. With the switch contact 120A of switch 120 thus closed, a circuit is completed to the timer motor 110 through leads 130, 132, 134, and 136 causing the timer motor 110 and the cams associated therewith to rotate. As the timer motor rotates, the cam switch 118 opens and closes but this does not effect the operation of the timer motor which is maintained in operation through the cam switch 120. As the timer motor 110 continues to rotate, the third cam 122 operates to open the switch contact 122A thereby de-energizing the coil 126. This operation signals the commencement of the dispensing cycle because at the same time that the contact 122A opens, the contact 122B closes providing a completed circuit for the water solenoid valve 46 and gear motor 86. The circuit for the gear motor 86 is completed through lead 138, lead 140, switch 122B and lead 142. The circuit for a solenoid 46 is completed through leads 144 and 146, manually operated switch 148, lead 150, lead 140, switch 122B and lead 142. The timer motor 110 continues to operate essentially on the cam 118 (first cam) until this cam rotates around to the first detent at which time power to the timer motor 110 by way of the cam switch 118 ceases. However, the timer motor 110 will continue to operate to the second detent as shown in FIG. 5A by continued power provided through lead 134, the normally closed contact 120B of cam switch 120, the by-pass switch 100, the closed contact 128C and lead 130. Once the first cam is in the position shown in FIG. 5A it is noted that the second cam has moved to its opposite position and thus the switch 120B opens interrupting power to the timer motor and ceasing operation with the cams as shown in FIG. 5A. Just prior to the finish of the cycle it is noted that the third cam also signals the end of the dispensing cycle by virtue of the contact 122B opening while the contact 122A closes. This operation, however, does not re-energize the relay coil 126 as the switch 124 is open (switch 124 is a momentary switch).

If the control circuit is to be set so that the vending machine is activated upon the insertion of a dime into the mechanism, the 5¢ blocking solenoid 108 is conditioned to close the 5¢ chute by opening switch 104, the switch 102 is closed so as to permit use of the 10¢ chute, and the by-pass switch 100 is maintained in its closed position. Under these conditions, the relay 126 is not energized and thus its contacts are maintained in the position shown in FIG. 3 with only the switch contact 128C closed. For the 10¢ vend reference is made to FIG. 5B. When a dime is deposited in the appropriate coin slot, the switch 160 closes which then energizes the 10¢ relay coil 162 of relay 164. The coil 162 has associated therewith contacts 164A and 164B. When the coil is energized the contact 164A closes and the coil 162 is maintained energized through the contact 164A and the contact 118B of cam switch 118. At the same time the switch contact 164B closes commencing operation of the timer motor 110. As soon as the timer motor rotates a short distance the cam switch 118B opens thereby de-energizing the relay coil 162. However, there is a running circuit provided for the timer motor 110 through leads 136 and 137, switch contact 118A, and lead 139. The motor continues to run essentially on the first cam until the cam 118 returns to its starting position. When the first cam reaches its first detent it interrupts a power to the timer motor. However, the timer motor is maintained operating through the cam switch 120, switch 100 and contact 128C until the switch contact 120B opens at which time further action ceases and the cams are in a position shown in FIG. 5B. It is noted that in the 10¢ vend position the cam track of the second cam has been changed to the second position so that the transition from the low portion of the cam to the higher portion of the cam occurs substantially concurrently with the third detent in the first cam. It is seen that in the first position of the cam track of the second cam, this transition corresponds with the second detent of the first cam as clearly indicated in FIG. 5A.

For the 15¢ vend the control is set so that the dispensing cycle is permitted only upon the depositing of one dime and one nickel. For this condition the by-pass or override switch 100 is maintained in its open or off position and both switches 102 and 104 are closed so as to prevent blocking on either of the chutes. The middle cam is reverted to its first position as in the 5¢ vend. Reference is now made to FIG. 5C concerning the 15¢ vend. The circuit of FIG. 3 is designed so that either the nickel or dime can be deposited first.

When a nickel is inserted in the machine the cams commencing in the position shown in FIG. 5C, coil 126 is energized and power is delivered by way of leads 130 and 132, and contact 128B to the switch contact 120A of the second cam switch 120. However, this switch 120 is open and thus no further action occurs upon the insertion of a nickel. Insertion of the dime into the machine closes the switch 160 and energizes the coil 162. The timer motor 110 operates through contact 164B with the relay 162 being maintained energized through contact 164A and cam switch contact 118B. The timer motor 110 thus moves the cams through the next detent at which time the cam switch 120 is activated continuing timer motor operation through the second cam and its normally open contact 120A. Once the dispensing cycle commences through operation of cam switch 122 the relay coil 126 is de-energized and continued timer motor operation is provided through the normally open contact 118A of the first cam switch 118. The circuit is completed through leads 137 and 139 and the switch contact 118A. With reference to FIG. 5C, as soon as the cam switch hits the first detent, timer motor operation ceases and the cams are, as shown in FIG. 5C in their initial starting position awaiting receipt of another nickel and dime.

If the person inserts the dime first the timer motor displaces through only a small rotation to the next detent in the first cam and the nickel must then be inserted to provide continued operation of the timer motor 110 by way of the second cam switch 120.

For a 20¢ vend the override switch 100 is closed and the solenoids 106 and 108 are conditioned so that the 10¢ chute is open and the 5¢ chute is closed. The middle cam is in its first position as with the 5¢ vend. Reference is made for the 20¢ vend operation to the diagram of FIG. 5A.

When the first dime is inserted, the coil 162 is energized and the timer motor 110 is operated through contact 164B being held closed until the timer motor rotates through a small angle to the third detent in the first cam. The coil 162 then de-energizes and the timer motor 110 ceases operation. The timer motor 110 cannot be operated through the cam switch 120 as the relay coil 126 is de-energized. When the second dime is inserted, the timer motor 110 is again similarly operated but now will be maintained operated as the first cam stays through most of its rotation on its high spot. When the first cam reaches its first detent power to the timer motor 110 is interrupted from the first cam path. However, the second cam then has its normally closed contact 120B closed and further power is provided to the timer motor via switch 100 and contact 128C so that the cams move through a further angle with the contact 118 aligning with the second detent in the cam 118'. For the 20¢ vend the cams then cease rotation in the position shown in FIG. 5A.

For the 25¢ vend switch 100 is open, both coin slots are unblocked, and the middle cam is in its second position. Reference is made to FIG. 5D.

When the first dime is inserted, switch 160 and the coil 162 operate as discussed previously to permit the cams to rotate from the first to the second detent. The second dime rotates the timer motor through a second small angle so that there is now alignment with the third detent of the first cam. When the nickel is then inserted the coil 126 is energized and power is provided to the timer motor 110 then by by of lead 130, contact 128B, lead 132, contact 120A, and lead 134. As before, the coins can be inserted in any order because of the two parallel circuit arrangements. For example, if a nickel is inserted first, then power is coupled to contact 120A. However, it is necessary to insert two dimes to then incrementally rotate the timer motor so as to close the contact 120A to permit dispensing cycle to commence. When the cams rotate so that the first detent of the first cam is reached all further rotation ceases and the cams are maintained in a rest position a shown in FIG. 5D.

For the 30¢ vend the switch 100 is in its open position and the 5¢ slot is blocked. The middle cam is in its second position and reference is made to FIG. 5D. The operation for this vend is quite similar to that for the 25¢ vend except that three dimes need to be deposited to move sequence from the first detent of the first cam to the second detent; from the second detent to the third detent; and from the third detent completely around to the first detent again so that the cams finally assume the position shown in FIG. 5D.

Having described one embodiment of the present invention it may now be appreciated that numerous modifications can be made in the illustrated embodiment, without departing from the scope of this invention. For example, rather than using a second cam that is adjustable, one could provide in its place a pair of cams corresponding to each adjustable position, and further provide settable switches that may be operated to select either one of the cam switches for operation depending upon the particular price chosen. Also, in accordance with the invention, other denominations of coin can be used. For example, the concepts of this invention could be applied to a cigarette dispensing machine where the coins used might be quarters and dimes or quarters and nickels. Also, the concepts of the invention can be applied to machines adapted to receive more than two coins such as those adapted to receive quarters, nickels and dimes.

What is claimed is:

1. Coin-operated control apparatus for a vending machine to control means for dispensing a product from the machine, said control being provided in an alterable manner to operate the means for dispensing on receipt of different total amounts of coinage, comprising;

at least a first cam and a second cam and first and second cam switch means associated, respectively, with the first and second cams, drive means for commonly supporting and simultaneously driving said first and second cams, first coin register means responsive to receipt of a coin of first denomination, second coin register means responsive to receipt of a coin of second denomination, means intercoupling said first coin register means and said first cam switch means to operate said drive means in predetermined positions of the first cam, means intercoupling said second coin register means and said second cam switch means to operate said drive means in predetermined positions of the second cam, and means responsive to rotation of the drive means from a start position upon receipt of the proper coin or coins for initiating and maintaining operation of said dispensing means for a predetermined period of time, said second cam having an adjustable cam track relative to the first cam track, the total coin amount for enabling the dispensing means being selectable at least in part by setting the second cam track to one of at least two different positions.

2. Coin-operated control apparatus as set forth in claim 1 wherein both said first and second coin register means comprise switch responsive means and relay means.

3. Coin-operated control apparatus as set forth in claim 1 wherein said means for initiating and maintaining operation comprises a third cam, said third cam also having a third cam switch means operated between at least two positions upon rotation of said third cam and being driven in common with said first and second cams.

4. Coin-operated control apparatus as set forth in claim 3 wherein said second and third cams each have only a high spot and a low spot.

5. Coin-operated control apparatus as set forth in claim 3 wherein said dispensing means comprises a gear motor operated on said third cam for a preset period.

6. Coin-operated control apparatus as set forth in claim 3 wherein in one position of said first cam switch said drive means is unconditionally operated at least until a first detent of the first cam is reached.

7. Coin-operated control apparatus as set forth in claim 6 wherein said first cam has a series of successive step detents for incrementally operating said drive means.

8. Coin-operated control apparatus as set forth in claim 7 wherein said first cam controls the drive means to increment the drive means for each coin deposited when more than one coin of a predetermined denomination is deposited.

9. Coin-operated control apparatus as set forth in claim 8 wherein said second cam is an override cam that can operate said drive means independently of control by said first cam.

10. Coin-operated control apparatus as set forth in claim 1 wherein said first coin register means includes chute means for receiving the first denomination coin and blocking means selectively operated to block the chute when the first denomination coin is not to be used.

11. Coin-operated control apparatus as set forth in claim 10 wherein said second coin register means includes chute means for receiving the second denomination coin and blocking means selectively operated to block the chute when the second denomination coin is not to be used.

12. Coin-operated control apparatus as set forth in claim 1 wherein said second intercoupling means includes a by-pass switch which in one position enables operation of said drive means.

13. Coin-operated control apparatus as set forth in claim 12 further comprising means associated with each coin register means for blocking the coin, said second cam having an adjustable cam track relative to the first and third cam tracks, the total coin amount for enabling the dispensing means being selectable by setting the blocking means, by-pass switch and second cam to predetermined positions.

14. Coin-operated control apparatus as set forth in claim 13 wherein said by-pass switch is closed, said first denomination blocking means is operated and said second cam is in a first track position for a 5¢ vend.

15. Coin-operated control apparatus as set forth in claim 13 wherein said by-pass switch is closed, said second denomination blocking means is operated and said second cam is in a second track position for a 10¢ vend.

16. Coin-operated control apparatus as set forth in claim 13 wherein said by-pass switch is open and said second cam is in a first track position for a 15¢ vend.

17. Coin-operated control apparatus as set forth in claim 13 wherein said by-pass switch is closed, said second denomination blocking means is operated and said second cam is in a first track position for a 20¢ vend.

18. Coin-operated control apparatus as set forth in claim 13 wherein said by-pass switch is open and said second cam is in a second track position for a 25¢ vend.

19. Coin-operated control apparatus as set forth in claim 13 wherein said by-pass switch is open, said second denomination blocking means is operated and said second cam is in a second track position for a 30¢ vend.

* * * * *